US005332135A

United States Patent [19]

Fletcher

[11] Patent Number: 5,332,135

[45] Date of Patent: Jul. 26, 1994

[54] APPARATUS FOR PROTECTING WATCHES AND THE LIKE

[76] Inventor: Stephen R. Fletcher, P.O. Box 1444, Layton, Utah 84041-6444

[21] Appl. No.: 981,175

[22] Filed: Nov. 24, 1992

[51] Int. Cl.[5] ..... G04B 37/00

[52] U.S. Cl. ..... 224/164; 224/171; 368/283

[58] Field of Search ..... 224/164, 171, 173, 178, 224/219, 242, 250, 267; 368/283, 286

[56] References Cited

U.S. PATENT DOCUMENTS

| | | | |
|---|---|---|---|
| 2,998,695 | 9/1961 | Cornett | 224/171 X |
| 4,155,219 | 5/1979 | Anderson | 368/283 X |
| 4,916,679 | 4/1990 | Agnello | 368/283 |

FOREIGN PATENT DOCUMENTS

| | | | |
|---|---|---|---|
| 3446331 | 6/1986 | Fed. Rep. of Germany | 224/178 |

*Primary Examiner*—Renee S. Luebke
*Attorney, Agent, or Firm*—Thorpe North & Western

[57] ABSTRACT

The present invention provides an apparatus for protecting an instrument, such as a wrist-mounted time keeping instrument, from damage or loss. Lengths of flexible material are used for shielding the attaching band of the instrument from the surrounding environment. The flexible material is formed into a band to encircle the user's limb using a hook and loop fastener. A channel is formed on the underside of the flexible material to hold the attaching band in place and to seal out containments found in the surrounding environment. The apparatus is used without removing or modifying the existing attaching band of the instrument. A cover hides the instrument and also seals the instrument from the surrounding environment. The cover is a stretchable cover which has an open position allowing easy access to the instrument and a closed position which seals the instrument from the surrounding environment. The apparatus provides the advantage of being lockable to the attaching band and the instrument preventing loss and damage but yet is removable therefrom without removing the instrument from the limb of the user. The apparatus has applications with many different types of instruments and in many different applications such as sporting activities and work activities.

3 Claims, 2 Drawing Sheets

APPARATUS FOR PROTECTING WATCHES AND THE LIKE

BACKGROUND

1. The Field of the Invention

This invention relates to devices used to protect a wrist watch, or other instrument which is attached to a body limb, against damage and loss.

2. The Prior Art

For many years the wearing of simple wrist watches has been common in modern societies. As technology has progressed, it has become common for people to wear sophisticated devices such as multi-function watches, heart rate monitors, calculators, telecommunication devices, and even other devices strapped to their wrist or other body limb. Thus, in the past protecting a watch from loss or damage has been a concern because of, for example, the value of the precious metal used in some watches. In recent years, however, protecting a valuable and sophisticated electrical instrument from damage and loss has become a major concern in many instances. Moreover, as people rely more and more on such multi-function watches and other sophisticated electronic instruments, such instruments must be worn continuously; thus it is even more important that they be protected from damage and loss and that such protection be provided conveniently so that the wearer will not be discouraged from using it.

In order to protect wrist mounted time-keeping instruments from damage, several devices have been proposed in the past. Many of the devices found in the prior art, however, make it difficult to access the instrument attached to the user's limb, thus discouraging use of the devices. Also many of the devices found in the prior art require that the attaching band supplied with the instrument be removed and replaced with a specialized structure. Furthermore, many earlier devices used to protect a watch or similar instrument from damage and loss are cumbersome or difficult to use. Still further, devices available in the prior art provide protection from loss or protection from damage, but not protection from both loss and damage. Even further, the earlier available devices often protect only the watch and not the attaching band. Thus, it would be a significant advance in the art to provide an apparatus to protect limb-mounted instruments from both damage and loss and which overcomes these other drawbacks.

OBJECTS AND BRIEF SUMMARY OF THE INVENTION

In view of the above described state of the art, the present invention seeks to realize the following objects and advantages.

It is a primary object of the present invention to provide an apparatus which protects limb attached instruments from both loss and damage.

It is another object of the present invention to provide an instrument protector which allows the instrument's existing attaching band to be used.

It is a further object of the present invention to provide an instrument protector which protects a limb mounted instrument from harm due to use in a harsh surrounding environment.

It is an additional object of the present invention to provide an instrument protector which allows easy access to the instrument when it is attached to the user's limb.

It is yet another object of the present invention to provide an instrument protector which is comfortable for the user to wear and convenient for the user to attach to a limb.

It is another object of the present invention to provide an instrument protector which protects both the instrument and the attaching band of the instrument.

It is a further object of the present invention to provide an instrument protector which can be removed from the user's limb without removing the instrument from the user's limb.

These and other objects and advantages of the invention will become more fully apparent from the description and claims which follow, or may be learned by the practice of the invention.

The present invention provides an apparatus for protecting an instrument, such as a wrist mounted watch, which is attached to a limb of a user and protects the instrument from damage or loss. Such instruments generally include an attaching band used to encircle the user's limb and attach the instrument thereto.

The apparatus includes a means for shielding the attaching band of the instrument from the surrounding environment. The preferred structure for the means for shielding comprises one or more lengths of flexible material which shield the attaching band. A means for forming the apparatus into a band encircling the user's limb allows the apparatus to be held in the desired location on the limb.

It is preferred that a hook and loop fastener be used to form the apparatus into a limb-encircling band. In the described embodiments, two openings are provided in the flexible material through which the attaching band passes adjacent to two sides of the instrument. The flexible material forms a belt means which encircles the user's limb.

The apparatus has the advantage of not requiring the attaching band of the instrument to be removed or modified. A means for holding the attaching band under the protective means for shielding is provided. In the preferred embodiments of the invention, the means for holding the attaching band comprises a channel formed on the inner side of the means for shielding. The channel also functions to fully shield the attaching band from the surrounding environment by creating a seal between the user's limb and the means for shielding.

The apparatus also hides and protects the instrument from the surrounding environment by way of a means for covering the instrument. In the described embodiments, the means for covering comprises a stretchable cover which includes an open position allowing access to the instrument and a closed position which seals the instrument from the surrounding environment. A hook and loop fastener preferably secures the means for covering into a position stretched over the instrument.

The apparatus also provides the advantage of being lockable to the attaching band and instrument to prevent loss but yet is removable therefrom without removing the instrument from the limb of the user. The apparatus has applications with many different types of instruments and in many different applications such as sporting activities and work activities.

BRIEF DESCRIPTION OF THE DRAWINGS

In order to better appreciate how the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
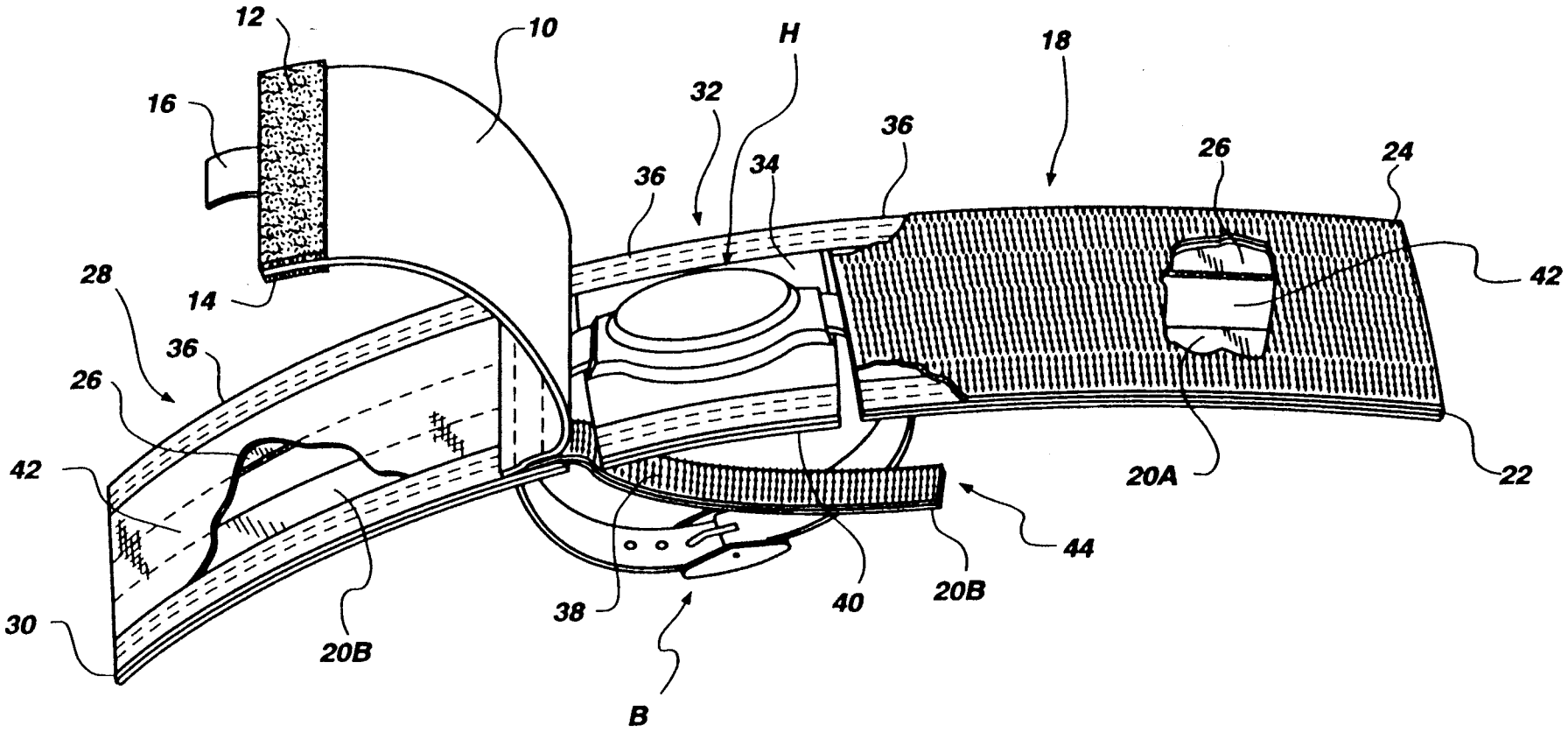
FIG. 1 is a perspective view of the presently preferred embodiment of the present invention.

Illustrated in FIG. 1 is an instrument, generally indicated at I, with its accompanying attaching band, generally indicated at B. As will be appreciated, the instrument can be a simple or multi-function time keeping instrument, a medical instrument, a computing instrument, a telecommunication instrument, or any other limb mounted instrument. The present invention may be used with any different type or style of limb mounted instrument.

For increased clarity, this description of the presently preferred embodiment of the present invention will use the example of a time-keeping instrument, i.e., a wrist watch, but this is not intended to limit the scope and application of the invention.

The instrument I is illustrated with its accompanying attaching band B. While the illustrated watch instrument I is intended to be attached to a user's wrist, instruments intended to be attached to any of the user's limbs, that is, any part of the user's arms or legs, can benefit from embodiments of the present invention.

Figure 2:
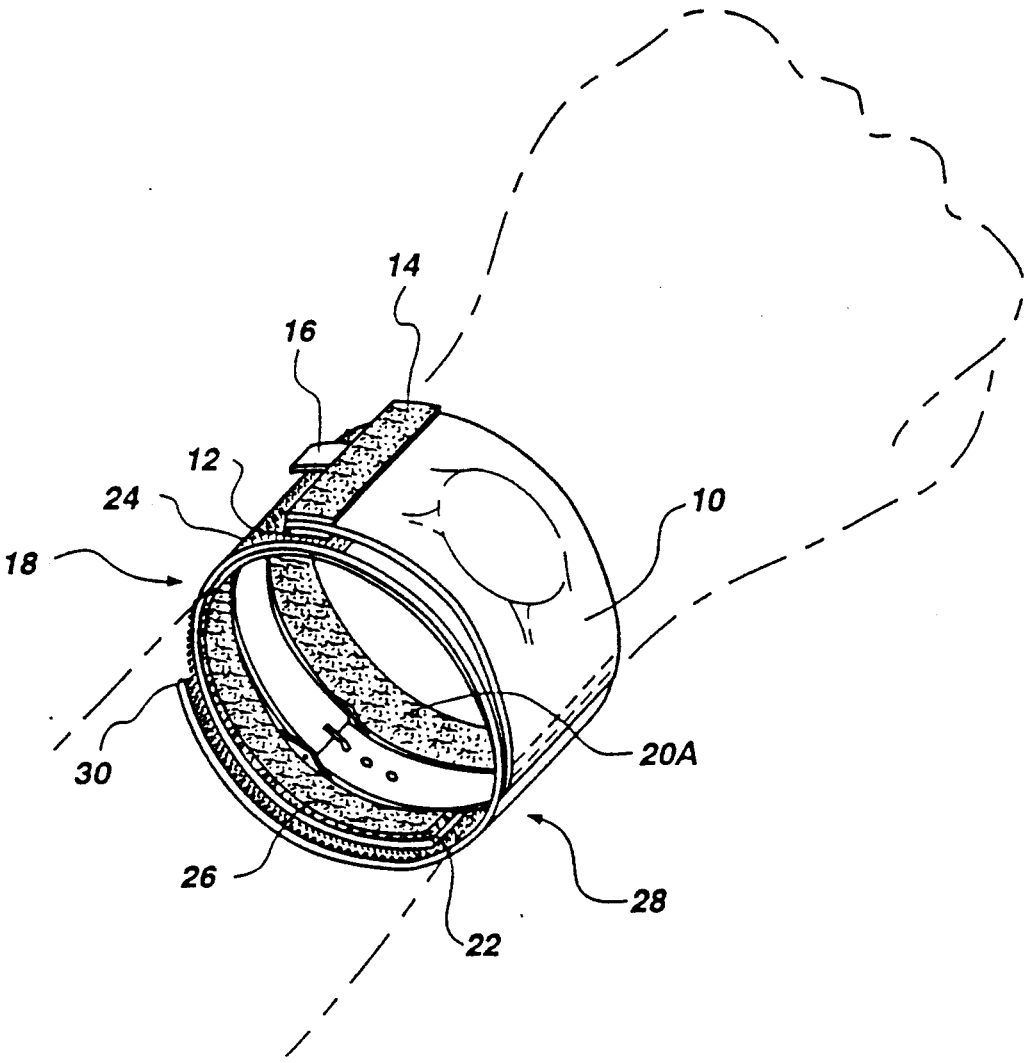
FIG. 2 is a perspective view of the embodiment represented in FIG. 1 attached to a user's limb.

The attaching band B which accompanies the instrument I may be one of any number of types or styles. For example, the attaching band B may comprise a two part flexible leather or fabric band with a buckle such as is illustrated in FIGS. 1 and 2. Also, the attaching band B may be a flexible or folding metallic band, a continuous elastic band, a two part band having any number of different fastening devices, or other type of attaching band, all of which can be used with the embodiments of the present invention.

Referring now particularly to FIG. 1, the belt structure of the illustrated apparatus of the present invention can be seen. The belt structure is wrapped and fastened around a user's limb as is illustrated in FIG. 2. As shown in FIG. 1, the belt structure includes a first belt portion (generally designated at 18) and a second belt portion (generally designated at 28). The first and second belt portions 18 and 28 include first and second lengths of material 22 and 30 which act as a substrate and are sandwiched between other components as will now be explained.

The lengths of material 22 and 30 can be fabricated from any number of commercially available materials as will be known to those skilled in the pertinent art. It is preferred that the materials used be strong, durable materials suitable for use in the particular environment. For example, when the environment will be a wet one the materials should be able to withstand damage when wet and also allow evaporation of any absorbed water within a reasonable length of time.

The stitching used to join together the components of the illustrated apparatus can be seen in FIGS. 1 and 2. While sewing is the preferred method of assembling embodiments of the present invention, other methods can also be used within the scope of the present invention.

One preferred material for forming the belt structure is a nylon fabric which is made using fibers available under the trademark CORDURA ® from E.I. du Pont de Neumors and Company of Wilmington, Delaware. As can be seen in FIGS. 1 and 2, along the edges of the lengths of material 22 and 30 a binding 36 is provided. It will be appreciated that while placing the binding 36 along all of the illustrated edges is not essential to the function of apparatus, good manufacturing practice suggests that a binding be used with some materials.

In the illustrated apparatus, the binding 36 runs as a continuous strip along one side of both the first and second portions 18 and 28 of the belt as well as a third, middle portion of the belt, generally designated at 32, which serves to hold all three belt portions 18, 28, and 32 together as will be described more fully shortly. For ease of description, it is noted that each of the belt portions 18, 28, and 32 includes an inner side which faces toward the limb of the user when being worn and an opposing outer side.

Referring still to FIG. 1, provided on the outer side of the material 22 is a layer of hook component 24 of a hook and loop fastener as is known in the art. It will be appreciated that other fastening systems, both those presently known and those which become available in the future, can also be used. Still, it is preferred that a hook and loop fastener such as one available under the trademark VELCRO be used. Importantly, the layer of hook component 24 does not contact the user's limb when worn. The binding 26 preferably extends under the layer of hook component 24 as shown in some of the cutaway portions of FIG. 1. Also, while not required, it is preferred that the layer of hook component 24 cover substantially all of the outer surface of the material 22.

Referring still to FIG. 1, the second portion 28 of the belt structure of the illustrated apparatus forms the other end of the belt structure. The second portion of the belt structure similarly includes inner and outer sides and the inner side contacts the user's limb when being worn. Thus, any surface which contacts the limb of the user must have suitable characteristics such as, for example, softness, absorption, durability, non-irritability of human skin. In some applications, the inner side may be against clothing or some other material but the embodiments of the present invention will generally be strapped around the user's limb directly against the user's skin.

Two strips of loop component 26 and 20B (of the before described hook and loop fastener) are included on the second portion of the belt structure. The strips 26 and 20B releasably adhere to the layer of hook component 24 thus joining the first and second ends of the belt structure and encircling the user's limb as shown in FIG. 2 (where the user's limb is represented in phantom image). It will be appreciated that with the apparatus illustrated in FIGS. 1 and 2, the belt structure can be fitted to limbs having a wide range of circumferences.

The strip of loop component 26 preferably extends along one edge of the entire length of the first and second belt portions 18 and 26 as can be seen in the partially cut away portions of FIG. 1. Other strips of loop component 20A and 20B similarly extend along the opposite edges of the first and second belt portions 18 and 26 such that the entire inner surfaces of the lengths of material 22, 30, and 40 are provided with two strips of loop component 36, 20A and 20B. When selecting the loop component 36, 20A and 20B for use in the embodiments of the present invention the characteristics which bear on user comfort (which were described earlier) should be considered.

As can be seen in the cut away portions of FIG. 1 and in the perspective view of FIG. 2, a channel 42 is formed on the inner side of the first and second belt portions 18 and 28. The channel 42 is preferably of a size and shape to accommodate the attaching band B when worn on the user's limb. The channel thus functions to hold the attaching band B under first and second belt portions 18 and 28 when worn on the user's limb. The strips of loop component 36, 20A and 20B provided along both edges of the belt structure also function to seal the channel from the surrounding environment. For example, with the continuous strips of loop component along both edges of the belt structure, sand, dirt, and other contaminants can be prevented from entering the channel thus preventing irritation of the user's skin and damage or wear to the attaching band B.

It will be appreciated that it is also within the scope of the present invention to use other structures to hold the attaching band B in position. For example, discontinuous strips of material can be provided along the edges of the belt structure to hold the attaching band in place if the function of sealing out sand, dirt, and other contaminants is not consequential. Still, the protection afforded to the attaching band B by the lengths of material 22 and 30 and from the strips of loop component 36, 20A and 20B is a significant advantage of the present invention. Moreover, the attaching band B, and as will be explained shortly the instrument I, are concealed from nearby observers thus discouraging theft.

Another significant advantage of the present invention is the releasable locking of the instrument I and attaching band B to the apparatus. Embodiments of the present invention can advantageously be removed from the instrument I and the attaching band B without requiring the removal of the instrument I and the attaching band B from the user's limb.

Represented in FIG. 1 is the middle belt portion 32 which includes a length of material 34 which is joined to the first and second lengths of material 22 and 30 by binding 36. The length of material 34 should be large enough to accommodate the instrument I. The described arrangement provides that the middle portion 34 is roughly coplanar with the first and second portions of the belt structure. The length of material 34 has inner and outer sides and three of its four edges are not permanently joined to other portions of the belt structure. In this fashion, openings are formed along the adjacent edges of the lengths of material 22, 30, and 34.

When being worn, the instrument I is positioned on the outer side of the length of material 34 while the attaching band B passes through the two openings formed between the lengths of material 22, 30 and 34 so that the attaching band B will remain in contact with the user's limb while being worn and the instrument is separated from the user's limb by material 34.

In order to lock the instrument into the belt structure of the illustrated embodiment a locking tab, generally designated at 44, is provided to close the two openings through which the attaching band B passes. The locking tab 44 comprises the strip of loop component 20B with a strip of hook component 38 attached thereto. The strip of hook component is joined at a first end to the outer side of the material 26. A corresponding strip of loop component 40 is provided on the loose edge of the inner side of material 34. The locking tab 44 is long enough so that when hook component 38 is joined to loop component 40 the hook component 38 reaches and releasably attaches to at least a portion of the strip of loop component 20A. In this way, the instrument I and the attaching band B are releasably locked to the apparatus. Significantly, the belt structure can be conveniently removed from the instrument I and the attaching band B, even without removing the instrument I and the attaching band B from the user's limb.

A cover 10 is provided to protect the instrument I from damage and, if desired, to conceal the instrument I. The cover 10 is attached to the material 26 so that it hinges between an open position and a closed position. The cover 10 is provided with a strip of loop material 12 along its loose edge so that the cover can be releasably joined to the hook component 24 thereby securing the cover 10 in its closed position as shown best in FIG. 2. Another strip of fastener component 14 is provided on the opposite side of the cover 10 to secure the cover 10 in its open position. When the illustrated embodiment is worn by a user, the cover 10 can be pulled in a reverse direction using the pull tab 16 and the strip of fastener component 14 can be attached to the layer of hook component 24, which is exposed to the opposite side of the wearer's wrists to secure the cover 10 in its open position. A pull tab 16 is provided to allow the user to easily move the cover 10 between the open position and the closed position. The pull tab 16 should be large enough so that a gloved hand, for example a hand wearing an underwater diving glove, can open and close the cover 10.

The cover 10 can be fabricated from many different materials. For example, if is not desired to conceal the instrument I, the cover 10 can be made of a transparent material or provided with a clear window. While the cover 10 has an open position to allow easy access to the controls of the instrument I, it will be appreciated that it is within the scope of the present invention to provide a cover 10 through which the controls and display of the instrument I can be manipulated and the cover 10 held in a closed position in a more permanent manner.

In most applications, it is preferred that the cover 10 be fabricated from a closed cell neoprene material available from Rubatex Corporation of Bedford, Virginia provided with a fabric covering made from a material such as LYCRA ®, both of which are well known in the pertinent arts. In applications requiring protection for the instrument I in sports and working environments, it is preferred that the cover 10 be fabricated from one of the neoprene materials available from Rubatex Corporation and designated as R-131-N provided with a fabric layer designated as 700 (LYCRA ®) or 900 (Standard light). Alternatively, the cover 10 can be fabricated using a nylon fabric with a separate neoprene pad provided therewith. While other materials can be used to fabricate the cover 10, the described material provides an advantageous combination of stretch, cushion, and strength for protection of the instrument I.

Moreover, the described preferred material for the cover 10 provides the characteristic of forming a seal around the instrument to prevent the entry of contaminants and dirt. As suggested in the representation of the cover 10 in FIG. 2, when the above-described material is used for the cover 10, the cover 10 conforms to the shape of the instrument and presses against the material 34 when the cover 10 is pulled taut and the strip of loop material 12 is attached to the hook component 24. Using this structure, the cover 10 seals the instrument I from the surrounding environment.

Moreover, when the cover 10 is taut, it can increase the tension of the belt structure around the user's limb. It is within the scope of the present invention to optimize the described structures, or utilize additional structures, to hold the apparatus snugly on the user's limb to prevent unwanted movement, such movement being particularly undesirable when the user is involved in active work or sports. It will be appreciated that the cover 10, as represented in FIG. 2, is not shown in its fully sealed configuration in order to better illustrate the pertinent structures.

When the user desires to access the instrument, the pull tab 16 is used to move the cover 10 to its open position. When access to the instrument I is finished, the pull tab 16 can be used to stretch and secure the cover over the instrument. It will be appreciated that the size, shape, and characteristics of the cover 10 can be adjusted to particularly suit the requirements of the instrument.

While the illustrated device is shown in FIG. 2 being worn around the user's wrist, the illustrated device can be worn at other positions on the user's limbs or modifications can be made to optimize use on other limbs. Moreover, the apparatus can be utilized with instruments and attaching bands of shapes, sizes, and types other than the instrument I and attaching band B illustrated herein.

In view of the forgoing, it will be appreciated that the present invention provides an apparatus which effectively protects limb attached instruments from loss and damage, is convenient to use, and is aesthetically pleasing. It will also be appreciated that the present invention provides an instrument protector which allows the instrument's existing attaching band to be used and which protects a limb mounted instrument from harm due to use in a harsh surrounding environment. It will be further appreciated that the present invention provides an instrument protector which allows easy access to the instrument when it is attached to the user's limb, which is comfortable for the user to wear and convenient for the user to attach to a limb, and which protects both the instrument and the attaching band of the instrument.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for protecting an instrument having an attaching band which encircles an upper limb of a user, the apparatus comprising:

a first length of material having inner and outer sides;

a loop fastener component positioned on the inner side of the first length of material, the loop fastener component having a channel formed along the length of the first length of material, the channel having a width to accommodate the band of the instrument;

a second length of material having inner and outer sides;

a hook fastener component positioned on the outer side of the second length of material such that the hook fastener component and the loop fastener component can be releasably joined together to encircle the limb of the user;

a third length of material having inner and outer sides, the third length of material attached between the first and second lengths of material such that the adjoining ends of the first and third lengths of material and the second and third lengths of material are partially unjoined so that the instrument can be positioned on the outer side of the third length of material away from the user's limb and the attaching band can be positioned on the inner side of the first and second lengths of material against the user's limb such that the attaching band is shielded from the surrounding environment when worn by the user;

means for covering the instrument such that the instrument is concealed from the surrounding environment, the means for covering having a closed position and an open position;

means for locking the instrument in a position between the third length of material and the means for covering such that both the instrument and the attaching band may be protected by the apparatus or the apparatus removed from the instrument and the attaching band.

2. An apparatus for protecting an instrument having an attaching band which encircles an upper limb of a user as defined in claim 1 wherein the means for covering comprises means for securing the means for covering over the instrument and wherein the instrument comprises a time-keeping device.

3. An apparatus for protecting an instrument having an attaching band which encircles an upper limb of a user as defined in claim 2 wherein the means for locking comprises a strap including a hook and loop fastening component and wherein the channel comprises an area between a first strip of loop component and a second strip of loop component, the first strip and the second strip being positioned on the inner side of the first length of material.

* * * * *